US011834876B2

(12) United States Patent
Li et al.

(10) Patent No.: US 11,834,876 B2
(45) Date of Patent: Dec. 5, 2023

(54) DOOR HINGE AND LAUNDRY TREATMENT DEVICE PROVIDED WITH DOOR HINGE

(71) Applicants: QINGDAO HAIER LAUNDRY ELECTRIC APPLIANCES CO., LTD., Shandong (CN); HAIER SMART HOME CO., LTD., Shandong (CN)

(72) Inventors: Wenwei Li, Shandong (CN); Benfu Xing, Shandong (CN); Jinkai Wang, Shandong (CN); Rongshuai Cai, Shandong (CN); Shaolei Yi, Shandong (CN)

(73) Assignees: QINGDAO HAIER LAUNDRY ELECTRIC APPLIANCES CO., LTD., Shandong (CN); HAIER SMART HOME CO., LTD., Shandong (CN)

( * ) Notice: Subject to any disclaimer, the term of this patent is extended or adjusted under 35 U.S.C. 154(b) by 644 days.

(21) Appl. No.: 16/962,417

(22) PCT Filed: Dec. 28, 2018

(86) PCT No.: PCT/CN2018/124684
§ 371 (c)(1),
(2) Date: Jul. 15, 2020

(87) PCT Pub. No.: WO2019/141066
PCT Pub. Date: Jul. 25, 2019

(65) Prior Publication Data

US 2020/0362504 A1 Nov. 19, 2020

(30) Foreign Application Priority Data

Jan. 16, 2018 (CN) ..... 201810040462.4

(51) Int. Cl.
*D06F 39/14* (2006.01)
*E05D 11/00* (2006.01)
(Continued)

(52) U.S. Cl.
CPC ..... *E05D 11/0081* (2013.01); *D06F 39/14* (2013.01); *E05D 3/02* (2013.01); *E05D 5/065* (2013.01); *E05Y 2900/312* (2013.01)

(58) Field of Classification Search
CPC ..... D06F 39/14; E05D 11/0081; E05D 3/02; E05D 5/065; E05Y 2900/312
(Continued)

(56) References Cited

U.S. PATENT DOCUMENTS 3,883,201 A 5/1975 Busoni
2017/0121880 A1 5/2017 Cheon et al.
(Continued)

FOREIGN PATENT DOCUMENTS

CN 105040370 A 11/2015
CN 105442278 A 3/2016
(Continued)

OTHER PUBLICATIONS

International Search Report (PCT/ISA/210) dated Apr. 3, 2019, by the Chinese Patent Office as the International Searching Authority for International Application No. PCT/CN2018/124684.
(Continued)

*Primary Examiner* — Tinsae B Ayalew
(74) *Attorney, Agent, or Firm* — BUCHANAN INGERSOLL & ROONEY PC

(57) ABSTRACT

A door hinge, and a laundry treatment device provided with the door hinge, includes a hinge mount, a hinge shaft and a rotating arm, a side of the rotating arm is provided with a wire passing groove, the rotating arm further includes a fixing clip, and a cavity structure is formed by the fixing clip
(Continued)

and the wire passing groove for allowing wire to pass. On the basis of the prior art, a wire passing structure of the door hinge is added, wiring of an energization component of the laundry treatment device with the door hinge can be facilitated, wires can be hidden by the wire passing structure, space is saved, and the attractiveness is improved; the wires are not liable to be worn or broken since the wires are placed in the groove; and all parts of the rotating arm can be disassembled for easy maintenance.

15 Claims, 4 Drawing Sheets

(51) Int. Cl.
*E05D 3/02* (2006.01)
*E05D 5/06* (2006.01)

(58) Field of Classification Search
USPC ..... 68/3 R
See application file for complete search history.

(56) References Cited

U.S. PATENT DOCUMENTS

| | | | | |
|---|---|---|---|---|
| 2017/0121898 | A1* | 5/2017 | Kwon | E05D 11/0081 |
| 2018/0142399 | A1 | 5/2018 | Chun et al. | |
| 2018/0216381 | A1 | 8/2018 | Lee et al. | |

FOREIGN PATENT DOCUMENTS

| | | | |
|---|---|---|---|
| CN | 205223658 | U | 5/2016 |
| CN | 106032637 | A | 10/2016 |
| CN | 106757994 | A | 5/2017 |
| DE | 2261275 | A1 | 5/1974 |
| EP | 3165667 | A1 | 5/2017 |
| KR | 20150130172 | A | 11/2015 |
| WO | 2017014492 | A1 | 1/2017 |
| WO | 2017018710 | A1 | 2/2017 |

OTHER PUBLICATIONS

Written Opinion (PCT/ISA/237) dated Apr. 3, 2019, by the Chinese Patent Office as the International Searching Authority for International Application No. PCT/CN2018/124684.

* cited by examiner

DOOR HINGE AND LAUNDRY TREATMENT DEVICE PROVIDED WITH DOOR HINGE

TECHNICAL FIELD

The present disclosure belongs to the field of household appliances, and particularly relates to a door hinge and a laundry treatment device provided with the door hinge.

BACKGROUND

With the technology development and diversification of household appliances, many household appliances have been provided with more powerful functional modules on doors, such as electrical components of display operation panels or light boxes for lighting. For the multiple extended functions, wires generally need to be arranged at hinge joints.

However, at present, hinge mechanisms of doors of most household appliances are not provided with wire passing structures and cannot supply power to door bodies, resulting in the problem that wires or cables are exposed or entangled on the door side, and the attractiveness of the household appliances is affected. Moreover, wires or cables are liable to be broken due to frequent rotation caused by repeated opening and closing of machine doors, resulting in safety accidents.

Some household appliances consuming water, such as washing machines, have stricter requirements on the wires. Once the wires of the water-consuming equipment are exposed, the wires are prone to making contact with water, which may cause electric shock accidents seriously. Therefore, the wiring mode for such appliances should be more concerned.

In view of this, the present disclosure is specifically proposed.

SUMMARY

The technical problems to be solved by the present disclosure are to overcome the defects of the prior art, and to provide a door hinge and a laundry treatment device provided with the door hinge.

In order to solve the above technical problems, the basic concept of the technical solutions adopted by the present disclosure is: a door hinge includes a hinge mount, a hinge shaft and a rotating arm. A side of the rotating arm is provided with a wire passing groove, the rotating arm further includes a fixing clip. A cavity structure for allowing wire to pass is formed by the fixing clip and the wire passing groove.

One end of the rotating arm is connected with the hinge mount via the hinge shaft, and another end of the rotating arm is configured to be connected with a machine door. The one end, close to the hinge shaft, of the rotating arm is provided with a through hole for allowing wire to pass. The wire passing groove is through the rotating arm from the through hole to the other end configured to be connected with the machine door.

The one end, connected with the hinge mount, of the rotating arm has a certain radian. The other end, configured to be connected with the machine door, of the rotating arm is of a planar structure, and an installation hole for being connected with the machine door are arranged on the planar structure. The wire passing groove includes an arc groove corresponding to an arc end of the rotating arm and a straight groove corresponding to the planar structure of the rotating arm.

The fixing clip is matched with the wire passing groove of the rotating arm in shape. The fixing clip includes an arc clipping section connected with and matched with the arc groove and a straight clipping section connected with and matched with the straight groove.

The fixing clip is detachably connected with the rotating arm.

Preferably, the fixing clip and the rotating arm are connected in a bolted or clamped mode.

The door hinge further includes an end cover; the end cover is detachably connected with the rotating arm. A tail of the end cover is hermetically connected with the through hole. The end cover is hollow inside for allowing wire to pass, is of a cambered surface structure as a whole matched with the rotating arm.

The end cover is provided with a fixing and guiding structure.

Preferably, the fixing and guiding structure of the end cover is arranged as a guide hole. The guide hole is arranged at an upper portion and/or a lower portion of the end cover. A size of the guide hole is set for fastening wires or cables. The end cover is connected with the rotating arm in a bolted or clamped mode.

The end cover and the fixing clip are also arranged as an integrated structure, and the end cover and the fixing clip which are integrally formed are detachably connected with the rotating arm.

Preferably, the end cover and the fixing clip which are integrally formed are connected with the rotating arm in a bolted or clamped mode.

The door hinge is provided with a limiting structure.

Preferably, the hinge mount or the rotating arm is provided with a stop protrusion which is located at a joint between the hinge mount and the rotating arm. The stop protrusion limit the rotation angle of the rotating arm relative to the hinge mount.

A laundry treatment device provided with the door hinge includes a machine door and a front panel. The hinge mount of the door hinge is connected with the front panel; the rotating arm of the door hinge is connected with the machine door. The machine door is rotationally connected with the front panel.

A door body of the laundry treatment device is provided with a decorative or lighting lamp, or the door body is provided with electrical components such as a control panel, and wires of the electrical components are introduced into a machine body through the door hinge for power supply.

After adopting the above technical solution, the technology has the main beneficial effects that:

1. The door hinge can be used for opening and closing of the machine door and the front panel, via the wire passing structure, the wires or the cables used by the components on the door can be hidden, the attractiveness of household appliances is improved, and the wiring safety performance is also achieved.

2. The wires or the cables are fixed in the wire passing groove, rotate together with the rotating arm and thus are prevented from being worn or broken due to frequent opening and closing of the machine door, and therefore the service life of the wires or the cables is prolonged.

3. The door hinge is simple, compact and reasonable in structure, the wire passing purpose is achieved by forming a groove on the rotating arm without adding extra parts, the overall size of the door hinge does not increase significantly, and spaces on door bodies of washing machines and other household appliances are saved.

4. All parts can be detachably connected, and links such as circuit repair or component replacement are more convenient.

5. For a laundry treatment device with a lamp or a control panel on a door body, wires can be arranged from the door hinge for the laundry treatment device adopting the door hinge, the wires or cables can be prevented from making contact with water in a washing machine body, leakage accidents are avoided, and the aesthetic performance of the appearance of the laundry treatment device is improved.

The specific implementation modes of the present disclosure will be described in further detail below with reference to the accompanying drawings.

BRIEF DESCRIPTION OF THE DRAWINGS

As a part of the present disclosure, the accompanying drawings are used to provide a further understanding of the present disclosure. The schematic embodiments and descriptions of the present disclosure are used to explain the present disclosure, but do not constitute an undue limitation on the present disclosure. Apparently, the accompanying drawings in the description below are merely some of the embodiments, based on which other drawings may be obtained by those of ordinary skill in the art without creative efforts. In the drawings.

Wherein:

1. door hinge;

11. hinge mount; 111, installation sleeves; 112, stop protrusion; 113, support ribs; 114, installation hole;

12. hinge shaft;

13. rotating arm; 131, through hole; 132, cambered surface structure; 133, planar structure; 134, wire passing groove; 135, installation sleeve; 136, installation hole;

14. fixing clip; 141, arc clipping section; 142, straight clipping section; 143, arc-shaped wire passing notch;

15. end cover; 151, guide hole; 152, tail plate; 153, screw hole; 154, insert plate;

16. screw;

2. machine door; 21, first machine door; 211, inclined structure; 212, control panel; 22, second machine door; and

3. front panel.

It should be noted that these accompanying drawings and text descriptions are not intended to limit the scope of the present disclosure in any way, but to explain the concept of the present disclosure to those skilled in the art by referring to specific embodiments.

DETAILED DESCRIPTION OF THE EMBODIMENTS

To make the objectives, technical solutions and advantages of the embodiments of the present disclosure clearer, the technical solutions in the embodiments will be described clearly and completely in conjunction with the accompanying drawings in the embodiments of the present disclosure below. The following embodiments are used to illustrate the present disclosure, but not to limit the scope of the present disclosure.

In the description of the present disclosure, it should be noted that azimuth or position relationship indicated by the terms such as "upper", "lower", "front", "rear", "vertical", "inner", "outer", "top end" and "tail" is based on the azimuth or position relationship shown in the accompanying drawings, is only for the convenience of describing the present disclosure and simplifying the description, rather than indicating or implying that referred devices or elements must have a specific orientation or be constructed and operated in a specific orientation, and therefore cannot be construed as limiting the present disclosure.

In the description of the present disclosure, it should be noted that unless otherwise clearly specified and limited, the terms "assembly", "installation", "connection" and "joint" should be understood in a broad sense, for example, it can be fixed connection, or detachable connection or integral connection; it can be mechanical connection or electrical connection; it can be direct connection or indirect connection through an intermediate medium. For those of ordinary skill in the art, the specific meanings of the above terms in the present disclosure can be understood in specific situations.

Figure 1:
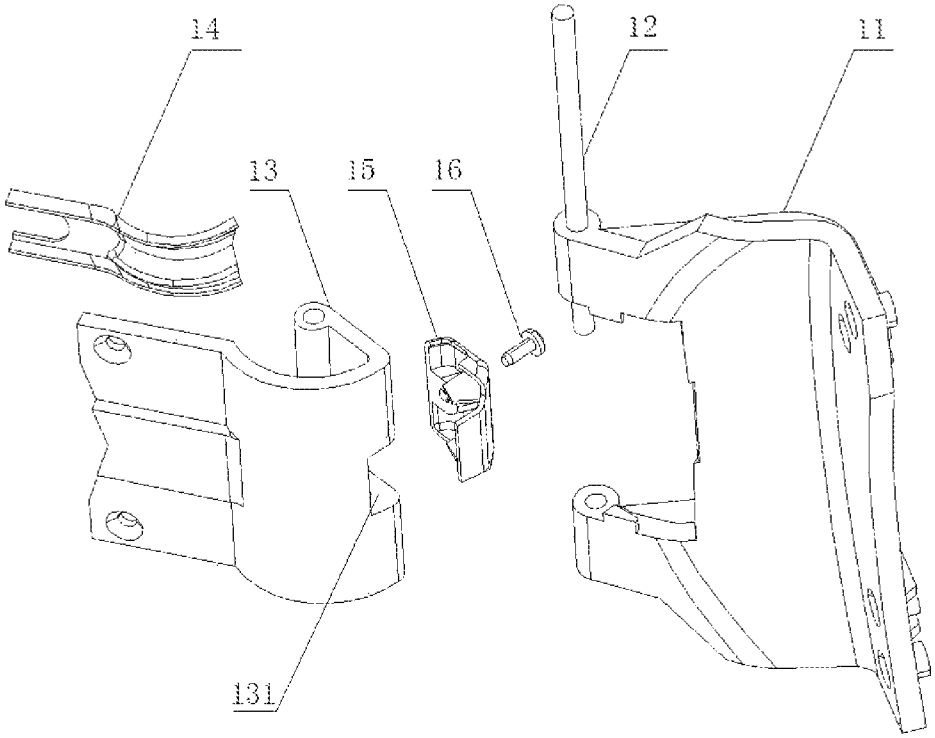
FIG. 1 is an exploded schematic view of a door hinge of the present disclosure.

A door hinge 1 includes a hinge mount 11, a hinge shaft 12 and a rotating arm 13. The rotating arm 13 is provided with a wire passing groove 134. The door hinge 1 further includes a fixing clip 14 and an end cover 15. FIG. 1 shows an exploded schematic view of the door hinge.

The hinge shaft 12 is used for connecting the hinge mount 11 with the rotating arm 13.

The hinge mount 11 and the rotating arm 13 are provided with installation sleeves, and a size of through holes at a central of the installation sleeves is matched with that of the hinge shaft 12. After the hinge shaft 12 is inserted into the installation sleeves, the hinge mount 11 and the rotating arm 13 can rotate relatively.

The hinge shaft 12 is of a cylindrical solid rod-shaped structure, or two cylindrical solid rods are inserted into the installation sleeves from two ends respectively.

One end of the hinge mount 11 is provided with two installation sleeves 111, and one end of the rotating arm 13 is provided with one installation sleeve 135. A height of the installation sleeve 135 of the rotating arm is equal to a distance between the two installation sleeves 111 of the hinge mount 11. The installation sleeve 135 of the rotating arm is placed between the two installation sleeves 111 of the hinge mount 11, and the through holes of the installation sleeve are aligned to form a whole through hole. After the hinge shaft 12 is inserted in the whole through hole, assembly of the door hinge 1 is completed.

Figure 2:
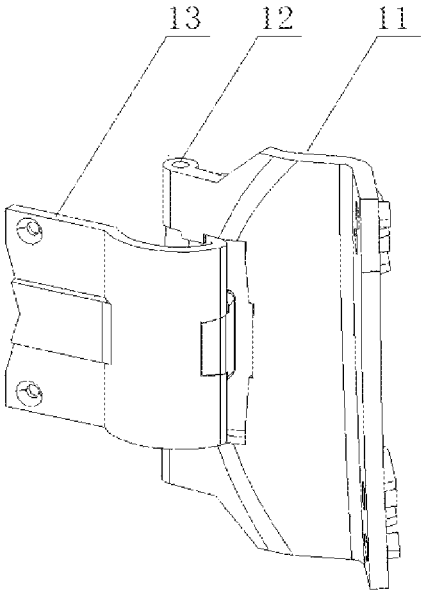
FIG. 2 is an assembly schematic view of a front of a door hinge of the present disclosure.
Figure 3:
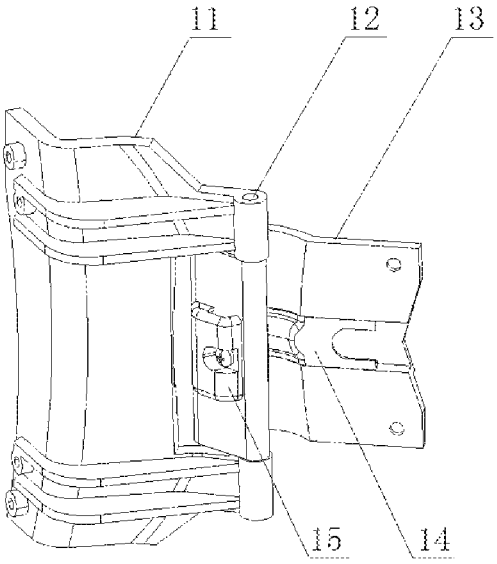
FIG. 3 is an assembly schematic view of rear of a door hinge of the present disclosure.

The door hinge assembled 1 is shown in FIGS. 2 and 3.

FIG. 2 is a schematic front view of the door hinge assembled. The wire passing groove 134, the fixing clip 14, a guide hole of the end cover 15 and internal wires cannot be observed from the front, and wires or cables drawn from electrical components needing to be installed at a machine door part can be hidden in the door hinge 1 and cannot be seen from the front, so that the purposes of beautification and safety are achieved.

FIG. 3 is a schematic rear view of the door hinge assembled. A structure for wiring can be seen. The fixing clip 14 and the end cover 15 are in cooperation and installed on the rotating arm 13. The end cover 15 is fixed to one end of the rotating arm 13 via a bolt, and the space between the two installation sleeves 111 of the hinge mount 11 is large and is used for rotation of the rotating arm 13 and avoiding the end cover 15 and other structures.

Figure 4:
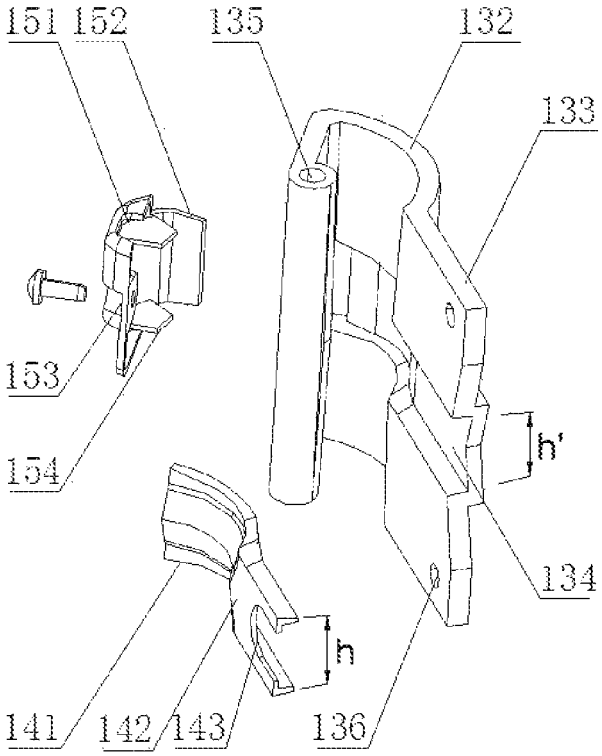
FIG. 4 is an exploded schematic view of a rotating arm of the present disclosure.

FIG. 4 shows an exploded schematic view of the rotating arm.

An end, close to the hinge shaft, of the rotating arm 13 is of a cambered surface structure 132. Due to a large curvature generated by the cambered surface structure 132, the machine door can be embedded, better sealing can be achieved, and avoiding the hinge shaft can be achieved. Another end of the rotating arm 13 is of a planar structure 133 provided with an installation hole 136 used for being fixedly connected with the machine door.

Preferably, the installation hole 136 is a circular hole or a threaded through hole and is connected with the machine door via a bolt.

The end, close to the hinge shaft, of the rotating arm 13 is provided with the installation sleeve 135 of the hinge shaft. The installation sleeve 135 is internally provided with a through hole, and the through hole is matched with the hinge shaft 12 in diameter.

Preferably, a height of the installation sleeve 135 is the same as a height of the rotating arm 13.

A through hole 131 is formed in the one end, close to the hinge shaft, of the cambered surface structure 132 of the rotating arm 13. The through hole 131 is used for allowing the wires or the cables to pass through the wire passing groove 134. The through hole 131 may be square, and a width of the through hole 131 is consistent with a width h' of the wire passing groove 134.

The wire passing groove 134 starts from the through hole 131 and penetrates to the other end, connected with the machine door, of the rotating arm 13. The wire passing groove 134 has a certain depth. The wire passing groove 134 is divided into two sections, one section is located at the planar structure 133 of the rotating arm to form a straight groove, and the other section is located at the cambered surface structure 132 of the rotating arm to form an arc groove. The widths of the two sections of the wire passing groove 134 are h' consistently.

As shown in FIG. 4, the fixing clip 14 is matched with the wire passing groove 134 in shape, and forms a cavity structure with a cross-sectional shape unchanged with the wire passing groove 134. The fixing clip 14 is divided into two sections, one section is a straight clipping section 142 installed in the straight groove of the wire passing groove 134, and the other section is an arc clipping section 141 installed in the arc groove of the wire passing groove 134. An outer width h of the fixing clip 14 is the same as the width h' of the wire passing groove 134 or slightly smaller than the width h' of the wire passing groove 134 so that the fixing clip 14 can be smoothly installed into the wire passing groove 134.

The fixing clip 14 has a certain thickness, and cavities with different cross-sectional areas are formed by placing fixing clips 14 with different thicknesses in the wire passing groove 134 for placing different types of wires and cables.

A length of the straight clipping section 142 of the fixing clip 14 is shorter than that of the straight groove of the wire passing groove 134, and a tail of the straight clipping section 142 of the fixing clip 14 is provided with an arc-shaped wire passing notch 143 which achieves wiring guiding and fixing effects.

The fixing clip 14 rotates together with the rotating arm 13. The fixing clip 14 is detachably connected with the wire passing groove 134.

Preferably, the fixing clip 14 is connected with the rotating arm 13 in a bolted or clamped mode.

More preferably, the wire passing groove 134 and the fixing clip 14 are in sliding fit, and the fixing clip 14 can be slidably connected into the wire passing groove 134 through the through hole 131.

The door hinge 1 further includes an end cover 15, and the end cover 15 is of an arc structure externally. The end cover 15 is installed at the one end, close to the hinge shaft, of the rotating arm 13 and covers the through hole 131. The end cover 15 is provided with a tail plate 152, and a size of the tail plate 152 is set to seal the through hole 131 to reduce exposure of the wires or the cables. The end cover 15 and the rotating arm 13 are detachably connected.

Preferably, the end cover 15 and the rotating arm 13 are connected via a screw, a head of the end cover 15 is provided with a screw hole 153, and the rotating arm 13 is provided with a corresponding screw hole. The end cover 15 and the rotating arm 13 are connected via the screw 16.

Optionally, the end cover 15 is clamped with the rotating arm 13.

The end cover 15 is provided with a guide hole 151. A position of the guide hole 151 is set according to the wiring needs. A size of the guide hole 151 is matched with the thickness of the wires for wire fixing.

Preferably, the guide hole 151 is located at the upper portion and/or the lower portion of the end cover 15.

An insert plate 154 is arranged inside the end cover 15 and used for positioned connection with the wire passing groove 134 and the fixing clip 14 to form an unblocked wire via mechanism and guide the wires or the cables. The remaining part inside the end cover 15 is hollow for placing the wires or the cables.

The end cover 15 and the fixing clip 14 can also be designed as an integrated structure. The insert plate 154 of the end cover 15 and a side edge of the fixing clip 14 are connected into the integrated structure which is inserted into the wire passing groove 134 of the rotating arm through the through hole 131 during installation.

The width of the through hole 131 is greater than the width h' of the wire passing groove 134 and the width h of the fixing clip 14 so that the end cover and the fixing clip which are of the integrated structure can be inserted into the wire passing groove 134 conveniently.

The end cover and the fixing clip which are integrally formed are detachably connected with the rotating arm 13.

Preferably, the connection mode is bolt connection. Preferably, the connection mode is clamping connection.

Figure 5:
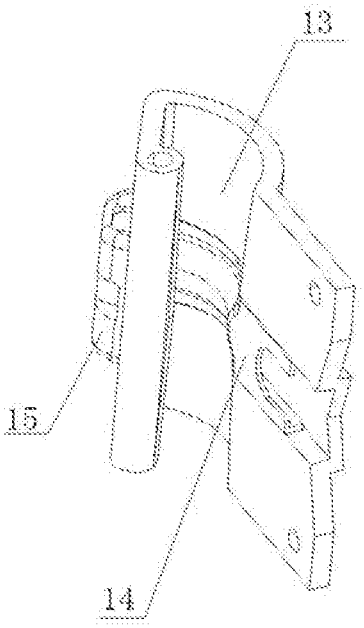
FIG. 5 is an assembly schematic view of a rotating arm of the present disclosure.

FIG. 5 shows an assembly schematic view of the rotating arm.

The fixing clip 14 is matched with the wire passing groove 134 in shape, and the fixing clip 14 is shown in FIG. 5 after installation.

The fixing clip 14 is put into the wire passing groove 134 to form the cavity structure for allowing wire to pass; one end of the cavity structure is provided with an opening for allowing wires or cables to pass. The guide hole 151 for wiring is formed in the upper portion after the end cover 15 is fixedly connected with the rotating arm 13 and can be used for allowing wires or cables to pass.

Figure 6:
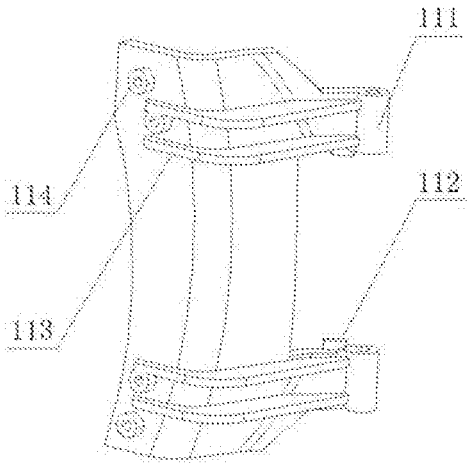
FIG. 6 is a schematic view of a hinge mount of the present disclosure.

FIG. 6 shows a schematic diagram of the hinge mount. The end, close to the hinge shaft, of the hinge mount 11 is provided with the installation sleeves 111 matched with the rotating arm 13. And installation of the door hinge 1 is completed by inserting the hinge shaft 12 in after the installation sleeves 111 of the hinge mount 11 and the rotating arm installation sleeve 135 of the rotating arm are spliced. Certain spaces are formed between the installation sleeves 111 of the hinge mount 11 for accommodating the installation sleeve 135 of the rotating arm and the end cover 15.

Another end of the hinge mount 11 is provided with an installation hole 114 used for assembly connection with a front panel.

Optionally, the installation hole 114 is a circular hole or a threaded through hole for bolt connection.

The hinge mount 11 is provided with a bent structure, an end which is provided with the installation hole 114 and used for being fixed to the front panel is a flat plate structure. An end provided with the installation sleeves 111 is of the bent structure which protrudes from the flat plate structure and is used for being connected with the rotating arm 13.

Preferably, a back of the hinge mount 11 is provided with support ribs 113 used for enhancing the overall strength of the hinge mount 11. The support ribs 113 traverse from the installation sleeves 111 to the other end so as to improve the overall stability of the door hinge.

The door hinge 1 is provided with a limiting structure for limiting the rotation angle of the door hinge 1.

Preferably, a stop protrusion 112 is arranged on the hinge mount 11 or the rotating arm 13. When the rotating arm 13 rotating to a required maximum angle, the rotating arm 13 or the hinge mount 11 makes contact with the stop protrusion 112 in order to limit the rotation at a greater angle.

Optionally, the stop protrusion 112 is arranged beside the through holes of the installation sleeves.

The door hinge has the beneficial effects that the wires or the cables pass through a wire passing structure, it can be ensured that the wires or the cables are surrounded by the cavity structure in the door hinge, the wires or the cables can be hidden and do not tangle with each other messily, and thus the overall attractiveness of a machine body is ensured.

The wires or the cables are not exposed out of the machine door or the machine body, thus the wires or the cables are not worn or broken due to opening and closing of the machine door, and accordingly the service life of the wires or the cables is prolonged.

The present disclosure further includes a laundry treatment device provided with the door hinge 1.

The laundry treatment device may be a drum washing machine or a dryer.

A door body of the laundry treatment device is provided with an energization component. In order to facilitate power supply and control circuit connection, the energization component needs to be connected with an interior of a laundry treatment device body via wires or cables. The wires or the cables can be connected with the energization component of the door body through the door hinge and the installation hole of the front panel of the laundry treatment device to realize the communication control function or power supply.

The door hinge 1 is provided with the limiting structure. The door hinge 1 is installed on the machine door 2 and the front panel 3. The limiting structure can limit the opening and closing angle of the door body. The opening and closing angle of the door body coincides with that of the rotating arm 13 of the door hinge.

Embodiment 1

Figure 7:
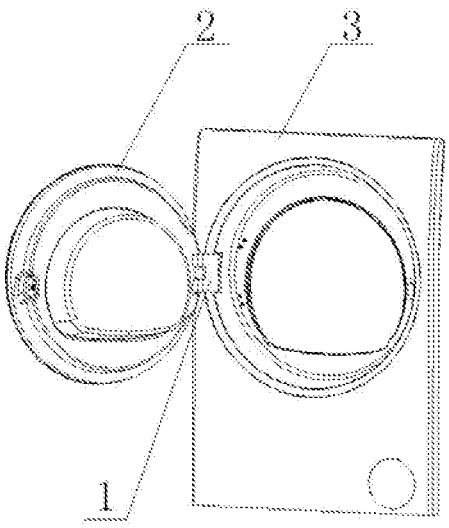
FIG. 7 is a schematic front view of assembly of a machine door and a front panel of the present disclosure.
Figure 8:
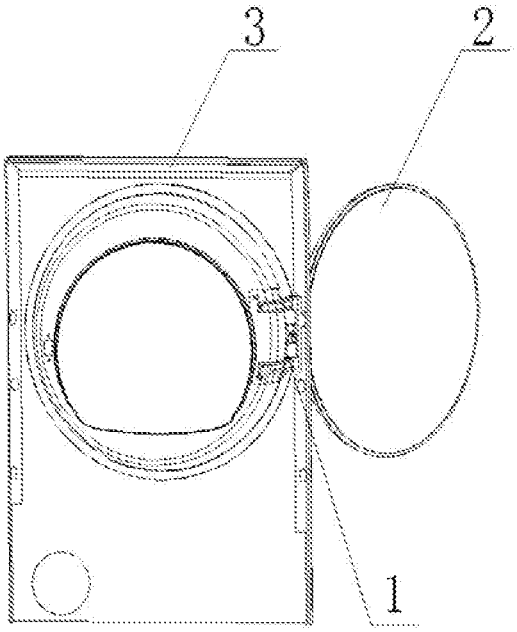
FIG. 8 is a schematic rear view of assembly of a machine door and a front panel of the present disclosure.

The embodiment provides a laundry treatment device provided with a door hinge 1, and the door hinge 1 is installed on a machine door 2 and a front panel 3 of the laundry treatment device, as shown in FIG. 7 and FIG. 8.

The front panel 3 is located at the front of the laundry treatment device and is tightly connected with a laundry treatment device body. The middle portion of the front panel 3 is provided with a laundry feeding port which can be used for laundry taking and placing after the machine door 2 is opened.

Further, the laundry feeding port is provided with an annular groove, a hinge installation area is arranged in the annular groove. The door hinge arranged on a side of the machine door 2 is assembled in the hinge installation area. An outer side of the hinge installation area is further provided with an avoiding structure allowing the machine door to open by rotation.

Preferably, an upper portion and a lower portion of the front panel 3 of the laundry treatment device are provided with inwards-recessed installation spaces correspondingly. The laundry feeding ports are respectively arranged in the installation spaces. The machine doors are embedded in the installation spaces and connected with the front panel 3 via the door hinges 1 so as to open/close the laundry feeding ports. The machine doors and the front panel 3 form a smooth front surface of the laundry treatment device.

FIG. 7 shows a schematic front view of assembly of the machine door and the front panel. The machine door 2 and the front panel 3 are provided with installation holes for being installed with the door hinge 1. The door hinge 1 is connected between the machine door 2 and the front panel 3 in a rotatable connection mode for opening and closing of the machine door 2. The energization component can be installed on the machine door 2, and adopted wires or cables penetrate through the front panel 3 and are connected with the energization component of the machine door through the door hinge 1. When the machine door 2 is opened or closed, no wires or cables are visible.

FIG. 8 is a schematic rear view of assembly of the machine door and the front panel. The hinge mount 11 is installed on the front panel 3 and is invisible since the hinge mount 11 is located inside the laundry treatment device body, and the guide hole 151 of the end cover faces the interior of the machine body.

After the door hinge 1 is assembled with the machine door 2 and the front panel 3, the wires or the cables are led out from a main machine body behind the front panel 3 and placed in the wire passing groove 134, and the wire passing groove 134 is closed by the fixing clip 14 to form the cavity structure, so that the cavity structure wraps the wires or the cables. Respective led ends of the wires or the cables are connected with the energization component on the machine door. When the wires or the cables are connected, the wires or the cables are fixed via the end cover 15. The end cover 15 is fixed on the rotating arm 13 via the screw 16 and adjusted according to the conditions of the wires and the cables. The upper portion or the lower portion of the end cover 15 is provided with the guide hole 151 so that the wires or the cables can be guided and fixed through the guide hole 151.

When the machine door 2 is opened or closed, the wires and the cables are rotated together with the rotating arm 13 and the machine door 2 without relative movement, and therefore the wires and the cables are prevented from being broken or worn due to frequent opening and closing of the machine door.

Embodiment 2

Figure 9:
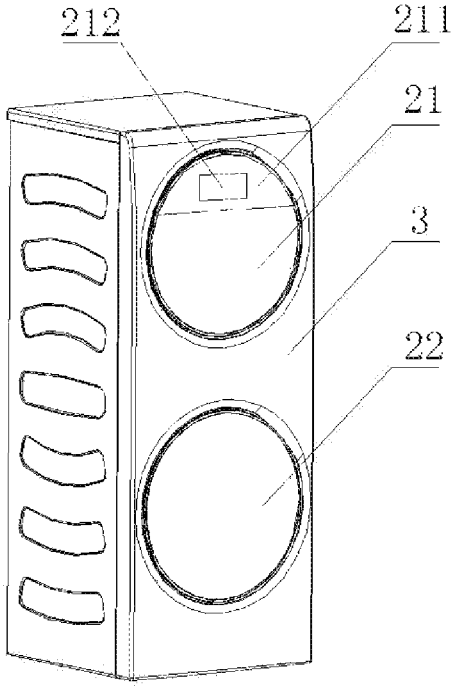
FIG. 9 is a schematic view of a twin-tub washing machine with a control panel on a machine door of the present disclosure.

On the basis of the Embodiment 1, the embodiment provides a laundry treatment device including a first laundry treatment device and a second laundry treatment device which are arranged up and down. FIG. 9 shows a twin-tub washing machine with a control panel arranged on a machine door.

The laundry treatment device includes a front panel 3 and machine doors.

The front panel 3 is an entire plate-like structure, is located at the fronts of the two laundry treatment devices and is tightly connected with side plates of the laundry treatment devices.

The machine doors include a first machine door 21 of the first laundry treatment device and a second machine door 22 of the second laundry treatment device. The machine doors are connected with the front panel 3 via door hinges.

In the above solution, the defined first laundry treatment device and the second laundry treatment device may be dryer drums or washing drums, or one of the laundry treatment devices is a dryer drum and the other laundry treatment device is a washing drum, wherein the front panel 3 is designed as an entire plate-like structure.

Preferably, the cross-sectional profile of the front panel 3 from top to bottom is a smooth line which gradually transitions from a curve to a straight line segment; or the cross-sectional profile of the front panel from top to bottom is a smooth line which gradually transitions from a straight line segment with a large inclination angle to a straight line segment with a small or no inclination angle.

In the above solution, an upper portion of the front panel 3 is arranged as an inclined structure 211 so that a user can observe and operate the laundry treatment device conveniently.

Preferably, a first laundry feeding port and a second laundry feeding port on the front panel are provided with the first machine door and the second machine door correspondingly. Wherein at least the first machine door is partially arranged as a curved structure curved toward a back side of the laundry treatment device or a planar structure inclined toward the back side of the laundry treatment device.

Preferably, the laundry treatment device is provided with the control panel 212 used to control both the first laundry treatment device and the second laundry treatment device, and the control panel is arranged on the inclined structure 211.

Wires of the control panel are arranged through the door hinge connecting the first machine door with the front panel.

In the above solution, by arranging the control panel on the inclined structure 211 of the first machine door 21, visual observation and operation on the laundry treatment device of a user are facilitated. Moreover, the control panel is arranged on the first machine door 21, thus, a height of the control panel is exactly matches a height of ordinary users, and the user operation experience is good.

Preferably, the laundry treatment device includes a first control panel for controlling the first laundry treatment device and a second control panel for controlling the second laundry treatment device. The first control panel is arranged on the inclined structure 211 of the first machine door 21, and the second control panel is arranged on the second machine door 22.

Preferably, the second machine door 22 is partially arranged as a curved structure curved toward the back side of the laundry treatment device or a planar structure inclined toward the back side of the laundry treatment device. The second control panel is arranged on the curved structure or planar structure of the second machine door 22.

A power source of the control panel 212 is the laundry treatment device body. The wires of the control panel communicate with internal circuits of the laundry treatment device through the wire passing groove 134 of the door hinge so as to achieve the purpose of controlling the laundry treatment device.

Wires of the first control panel are passing through the door hinge connecting the first machine door 21 with the front panel; and wires of the second control panel are passing through the door hinge connecting the second machine door 22 with the front panel.

Parameters of the two door hinges may be set differently according to different wiring in a control circuit, such as the width of the wire passing grooves and the length of rotating arms.

According to the above two embodiments, for water-consuming equipment such as washing machines, by hiding the wires or the cables through the door hinge 1, the energization component is isolated from water, so that the overall safety performance of equipment is greatly improved.

Machine doors of household appliances or each kind of equipment integrates various functions or operation panels to facilitate people operation and use. The wire passing function of the door hinge 1 provides support and convenience for the technology. The integration of the door hinge and the wire passing structure makes the structure simple and compact, a large space can be saved, components and parts are simplified, and electrical equipment is more exquisite and attractive.

The above description is only the preferred embodiments of the present disclosure, and does not limit the present disclosure in any form. Although the present disclosure has been disclosed with the preferred embodiments above, it is not intended to limit the present disclosure. Any person skilled in the art who is familiar with this patent can make some equivalent changes such as variations or modifications to equivalent embodiments based on the technical content suggested above without departing from the scope of the technical solutions of the present disclosure, but any simple variations, equivalent changes and modifications made to the above embodiments according to the technical essence of the present disclosure without departing from the content of the technical solutions of the present disclosure still fall within the scope of the present disclosure.

The invention claimed is:

1. A door hinge, comprising:

a hinge mount;

a hinge shaft and a rotating arm, wherein a side of the rotating arm is provided with a wire passing groove, the rotating arm is provided with a fixing clip, and a cavity structure for allowing wire to pass is formed by the fixing clip and the wire passing groove;

one end of the rotating arm is connected with the hinge mount via the hinge shaft, another end of the rotating arm is configured to be connected with a machine door;

the one end of the rotating arm, connected with the hinge mount, has a curved shape in a cross-section perpendicular to the hinge shaft, the other end of the rotating arm, configured to be connected with the machine door, is of a planar structure, and the wire passing groove includes a curved groove corresponding to the one end having the curved shape of the rotating arm and a straight groove corresponding to the planar structure of the rotating arm.

2. The door hinge according to claim 1, wherein the one end of the rotating arm is provided with a through hole for allowing wire to pass, and the wire passing groove extends from the through hole to the other end of the rotating arm configured to be connected with the machine door.

3. The door hinge according to claim 2, wherein, an installation hole for being connected with the machine door is arranged on the planar structure.

4. The door hinge according to claim 1, wherein the fixing clip is matched with the wire passing groove of the rotating arm in shape, the fixing clip comprises a curved clipping section connected with and matched with the curved groove and a straight clipping section connected with and matched with the straight groove.

5. The door hinge according to claim 4, wherein the fixing clip is detachably connected with the rotating arm.

6. The door hinge according to claim 1, wherein the door hinge is provided with a limiting structure, the hinge mount or the rotating arm is provided with a stop protrusion which is located at a joint between the hinge mount and the rotating arm, and the stop protrusion limits a rotation angle of the rotating arm relative to the hinge mount.

7. A laundry treatment device provided with the door hinge according to claim 1, comprising:

a machine door; and a front panel, wherein the hinge mount of the door hinge is connected with the front panel, the rotating arm of the door hinge is connected with the machine door, and the machine door is rotationally connected with the front panel.

8. The door hinge according to claim 5, wherein the fixing clip and the rotating arm are connected in a bolted or clamped mode.

9. A door hinge comprising:

a hinge mount;

a hinge shaft;

an end cover; and a rotating arm, wherein a side of the rotating arm is provided with a wire passing groove, the rotating arm is provided with a fixing clip;

a cavity structure for allowing wire to pass is formed by the fixing clip and the wire passing groove;

one end of the rotating arm is connected with the hinge mount via the hinge shaft, another end of the rotating arm is configured to be connected with a machine door;

the one end of the rotating arm is provided with a through hole for allowing wire to pass, and the wire passing groove extends from the through hole to the other end of the rotating arm configured to be connected with the machine door;

the end cover is detachably connected with the rotating arm, a tail of the end cover is hermetically connected with the through hole, the end cover is hollow inside for allowing wire to pass and is of a cambered surface structure as a whole matched with the rotating arm, and the end cover is provided with a fixing and guiding structure.

10. The door hinge according to claim 9, wherein the fixing and guiding structure of the end cover is a guide hole, the guide hole is arranged at an upper portion and/or a lower portion of the end cover, a size of the guide hole is set for fastening wires or cables, and the end cover is connected with the rotating arm in a bolted or clamped mode.

11. The door hinge according to claim 10, wherein the end cover and the fixing clip are arranged as an integrated structure, and the end cover and the fixing clip which are integrally formed are detachably connected with the rotating arm.

12. The door hinge according to claim 9, wherein the fixing clip is matched with the wire passing groove of the rotating arm in shape, the fixing clip comprises a curved clipping section connected with and matched with the curved groove and a straight clipping section connected with and matched with the straight groove.

13. The door hinge according to claim 12, wherein the fixing clip is detachably connected with the rotating arm.

14. A laundry treatment device provided with the door hinge according to claim 9, comprising:

a machine door; and a front panel, wherein the hinge mount of the door hinge is connected with the front panel, the rotating arm of the door hinge is connected with the machine door, and the machine door is rotationally connected with the front panel.

15. The door hinge according to claim 9, wherein the door hinge is provided with a limiting structure, the hinge mount or the rotating arm is provided with a stop protrusion which is located at a joint between the hinge mount and the rotating arm, and the stop protrusion limits a rotation angle of the rotating arm relative to the hinge mount.

* * * * *